US006951290B2

(12) United States Patent
Speed

(10) Patent No.: US 6,951,290 B2
(45) Date of Patent: Oct. 4, 2005

(54) SHELF EDGE DISPLAY FITTINGS

(75) Inventor: Neil Hugh Forsyth Speed, Nottingham (GB)

(73) Assignee: Lighthouse Display International Limited (GB)

( * ) Notice: Subject to any disclaimer, the term of this patent is extended or adjusted under 35 U.S.C. 154(b) by 0 days.

(21) Appl. No.: 10/332,249

(22) PCT Filed: Jul. 4, 2001

(86) PCT No.: PCT/GB01/03010

§ 371 (c)(1),
(2), (4) Date: May 12, 2003

(87) PCT Pub. No.: WO02/03837

PCT Pub. Date: Jan. 17, 2002

(65) Prior Publication Data

US 2003/0178384 A1 Sep. 25, 2003

(30) Foreign Application Priority Data

Jul. 7, 2000 (GB) ..... 0016772

(51) Int. Cl.[7] ..... A47F 5/08

(52) U.S. Cl. ..... 211/113; 211/57.1; 211/59.1; 211/118

(58) Field of Search ..... 211/113, 57.1, 211/59.1, 118, 72, 54.1, 119.003; 248/220.41, 220.21, 220.31; 40/642.01, 642.02, 661.03

(56) References Cited

U.S. PATENT DOCUMENTS 3,182,810 A * 5/1965 Fahrenwald ..... 211/118
4,034,865 A * 7/1977 Batts et al. ..... 211/118
5,346,166 A 9/1994 Valiulis
5,415,370 A * 5/1995 Valiulis ..... 248/220.41
5,678,699 A * 10/1997 Gebka ..... 211/57.1
5,678,795 A * 10/1997 Henry et al. ..... 248/220.41
5,683,003 A 11/1997 Gebka
5,722,625 A * 3/1998 Kenney ..... 248/220.41
5,984,118 A 11/1999 Morrow
RE36,669 E * 4/2000 Zilincar, III ..... 211/86.01
6,082,687 A * 7/2000 Kump et al. ..... 248/220.41
6,341,755 B1 * 1/2002 Kump ..... 248/220.41

FOREIGN PATENT DOCUMENTS

| | | |
|---|---|---|
| GB | 498535 | 1/1939 |
| WO | WO 9853722 | 12/1998 |
| WO | WO 9942981 | 8/1999 |

* cited by examiner

*Primary Examiner*—Carl D. Friedman
*Assistant Examiner*—Jennifer E. Novosad
(74) *Attorney, Agent, or Firm*—Trexler, Bushnell, Giangiorgi, Blackstone & Marr, Ltd

(57) ABSTRACT

A shelf edge display fitting (10) comprises a first support member (12) adapted to be releasably attached to a shelf (34), a second support member (14) extending from the first support member (12) so that when the shelf edge display fitting is attached to the shelf (34) the second support member (14) extends outwardly from the shelf in a plane substantially parallel to or co-planar with the plane of the shelf, said second support member (14) carries projections (28) to support products (not shown) to be displayed, the first support member (12) is provided with a shoulder (30) to compensate for variations in level between the shelf (34) and the shelf edge (36).

10 Claims, 6 Drawing Sheets

FIG 3
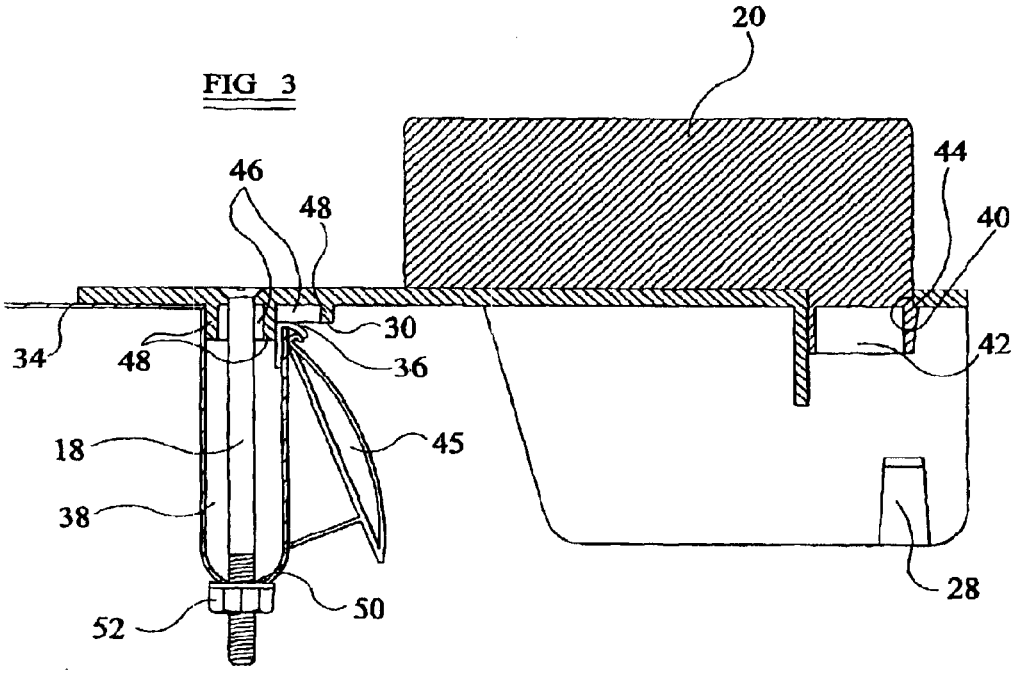
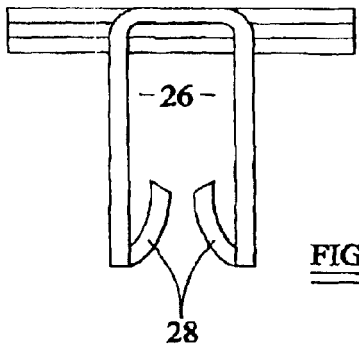
FIG 4

SHELF EDGE DISPLAY FITTINGS

BACKGROUND OF THE INVENTION

This invention relates to shelf edge display fittings particularly to fittings for hangers for merchandising strips.

In shops and particularly supermarkets products are often promoted in conjunction with other products in what is usually referred to as cross merchandising. For example, washing up liquid, the primary product, might be promoted with a secondary product such as dish cloths or tea-towels. In some cases the secondary product may usually be found in a different section of the store to the primary product and a display is needed to draw attention to the connection and actively promote the secondary product. It is not unusual for the secondary product to be relatively small compared to the primary product and not best suited to display directly on the same shelf particularly where the eye is naturally drawn to the primary product in its usual place in the store. Likewise the shopper may not be specifically or even actively searching for the secondary product at all.

Thus it has become the practice to mount secondary products on a strip depending from a shelf edge containing the primary product. For convenience and also to help promote the secondary product the strip is better displayed away from the shelf edge and deeper in to the aisle between the shelves, preferably with the products arranged so that they face shoppers directly as they progress up or down the aisle. Various fittings have been proposed for carrying the strip such as those described in U.S. Pat. Nos. 5,683,003 and 5,346,166.

Both these patents describe fittings adapted to carry at least one strip and which are held to the shelf by at least one protrusion extending from a bracket, which protrusion projects through an aperture in the shelf and adapted to engage the surface under the shelf.

In U.S. Pat. No. 5,683,003, a single protrusion is proposed integral with a plastics moulded fitting adapted for use with a specific type of shelf, popular in U.S. stores and having two rows of parallel spaced apertures alongside and parallel to the shelf edge. The single protrusion locates in an aperture in the inner row whilst an integral peg locates in h a corresponding aperture in the outer row. Much depends upon the strength on the single protrusion which invariably does not cope with repeated use and misuse.

U.S. Pat. No. 5,346,166 partly overcomes this disadvantage by using a formed metal plate construction and two protrusions adapted to engage adjacent apertures in the same row. In order that the protrusions can fir their apertures they must be relatively narrow and substantially the same thickness as the main body of the fitting and thus the protrusions are apt to bend in use either through lengthy use or through overloading or general misuse. A further disadvantage with this proposal is that the spacing between the protrusions must match the spacing between the apertures.

This is the same for the other constructions employing the same twin protrusions. These and others are simple derivations from the simple metal rod constructions where free ends of a bent wire or rod are kinked to locate in apertures whilst the bent portion is adapted to carry the merchandise.

Yet another disadvantage with protrusion/aperture fittings is that they are not securely attached to the shelf and can be easily dislodged.

It has also been found that with a variety of different shelving systems available, and in use, particularly with regard to the configuration of shelf edge, the prior art fitting cannot be adapted either in use or in the manufacturing process to suit such variety. One particular problem is where label holders and other shelf edge displays are concerned.

SUMMARY OF THE INVENTION

According to one aspect of the present invention a shelf edge display fitting comprises a first support member adapted to be releasably attached to a shelf, as second support member extending from the first support member so that when the shelf edge display fitting is attached to a shelf the second support member extends outwardly from the shelf in a plane substantially parallel to or co-planar with the plane of the shelf, said second support member carrying at least one means to support products to be displayed, characterised in that the first support member is provided with means to compensate for variations in level between the shelf and the shelf edge.

The shelf edge display fitting may be made from any suitable material such as injection-moulded plastics.

The first support member may be attached to the shelf by any suitable means, such as by the use of prior art protrusions, or preferably by at least one screw or by bolting to a hole or aperture in the shelf or shelf edge.

The means to support products is preferably formed integral with the second support member and comprises at least one, but preferably two projections onto which products, or more usually strips carrying the products can be hung.

Said projections may be any convenient shape or size such as, studs, pegs, hooks and the like, and may be provided with means to prevent or deter the accidental removal of products/strips. Such means may be provided by the projections themselves as in the case of the head of a stud or where pegs of hooks are used may be in the form of a collar, barb, notch or groove which may be formed integral with the projection or provided in the form of a ring fixed to the peg or hook as required.

It has been identified that one weakness in the prior art constructions is that as the products are removed from a strip the weight of the strip logically reduces and thus the downward forces holding the strip on its projection also reduce. When one or more of the remaining products is removed, usually from the lower portion of the strip, there is an increased tendency for the strip to lift and become dislodged from its projection. The consequences of this are manifold. Firstly, there is an embarrassment to the shopper who may abandon the strip on the floor of the aisle, and may even forgo purchasing the product, not only on that occasion but on any subsequent occasion when presented with such a display fitting. Abandoned strips present further problems as any remaining product may become damaged by passing shoppers and their trolleys before a member of the store's staff can intervene. Of more concern to the conscientious store is that such debris in an aisle can present a hazard upon which an unsuspecting shopper may slip and sustain an injury thereby creating an unwelcome liability to the store.

In one embodiment the means to prevent accidental removal of a strip from a projection is provided by a generally downwardly projecting ridge adapted to resist upward movement of the strip on the projection thereby considerably reducing the likelihood of abandoned strips and products.

In one preferred embodiment the second support member comprises a pair of spaced substantially parallel members depending from the second support member, substantially at right angles thereto, one from each side of the second support member to define a space between said members, the means to support the products being attached to said members, Said means may extend from either side of each member but, for convenience and added safety extend into the space between the members. Preferably, and to ease manufacture during the injection-moulding process, the members diverge slightly.

A popular shelf construction comprises a rolled metal sheet having a rolled edge formed into a channel depending from (and usually perpendicular thereto) extending along said edge and adapted to carry a label holder, usually a strip-like arrangement attached to the channel; along the length of the shelf edge. Conveniently the label holder is adapted to present labels at an angle to the shelf edge such that the labels face up and away from the shelf. This ensures that the labels can be readily seen. For convenience a shelf edge display fitting needs to be simply and securely attached to the shelf, if bolts or screws are used a plurality (at least 3) would be required to prevent the shelf edge display fitting sagging where the label holder sits lowers than the shelf level. It will also be appreciated that if the prior art protrusions were used then such sagging would place undue strain on what has already been identified as a weak point in the prior art designs.

The channel is preferably provided with drainage holes at each end thereof. This construction differs from shelving arrangements of the type where shelves are provided with a series of apertures along their length arranged in at least one row adjacent the shelf edge and where it is possible to use more than one aperture to provide a secure fitting without the need of the features of the present invention.

As has already been stated the shelf edge display fitting may be attached to the shelf by a screw or screws or by a bolt or bolts. It will be readily seen that either or both of the drainage holes can be used in such an arrangement.

The means provided on the first support member to compensate for variations in level between the shelf and the shelf edge may be formed integrally with the first support member or be provided by at least one separate component. Where the compensations means is formed integrally with the first support member where each type of shelving needs to be catered for it will be appreciated that only minor variations in dimension and or arrangement of compensation means may be required. To avoid the need for further expensive tooling, through replication of unchanged parts, adjustable tooling may be used to allow for this adjustment, for example whenever the shelf edge display fitting is made in injection moulded plastics.

The means provided on the first support member to compensate for variations in level between the shelf and the shelf edge may comprise at least one shoulder depending from the first support member and adapted to rest upon at least part of a lowered section of shelf edge so that the shelf edge display fitting can be supported in a plane substantially parallel to the level of the shelf thereby ensuring that the shelf edge display fitting is itself as near horizontal as possible.

At least one throughbore may be provided in the first support member to allow the shelf edge display fitting to be secured to the shelf. Additional throughbores may be provided to allow the shelf edge display fitting to be attached to the shelf at different depths on the shelf.

In one preferred embodiment a single throughbore is arranged so that the shelf can be readily bolted or screwed to a drainage hole in the channel. Means may be provided to engage the channel providing a secure seat therein and to assist in preventing lateral movement of the shelf edge display fitting in use.

As will be appreciated on this type of shelving system there will be no apertures available than drainage holes and it may be convenient to bolt the shelf edge display fitting through at least one aperture. To allow for variations in the position of drainage hole the throughbore(s) may be slotted to allow a degree of adjustment when fitting.

The means to engage the channel may be provided by any suitable construction but is preferably a further shoulder depending from the first support member The shoulder or shoulders may be solid block-like sections having a continuous lower surface for contact with the shelf edge. Alternatively they may be formed as hollows bounded by walls depending from the first support member. The lower edges of the walls producing the surface for contact with the shelf edge. The shoulder or shoulders may extend the full width of the first support member or a part thereof, or may be made up of more than one segment providing the resulting shoulder is sufficient to provide stable support on the shelf edge.

Where the shoulder or shoulders are not formed integrally with the shelf edge display fitting a number of separate shoulders may be provided of varying depths for use with a variety of different shelving systems. Such separate shoulders may be or permanently attachable to the first support member. Alternatively a variety of shoulder depths may be provided by a series of layers built up to provided the desired depth. Again these may be removably or permanently attachable.

The shoulders may also be mechanically adjustable, for example by providing a hinged sections depending from the first support member and adapted to be moved through a series of positions to provide a variety of depths. Alternatively the shoulders may be attach to the first support member by means of a screw or other thread which may be slackened or tightened as appropriate to raise or lower the shoulder thereby achieving a variation in depth.

The second support member may be provided with a label carrier extending upwardly therefrom and substantially perpendicular thereto. Preferably the label carrier is formed from injection-moulded plastics as a sheet having substantially planar sides or faces capable of receiving adhesive labels. Alternatively at least one of the sides may be printed, embossed or otherwise permanently marked. At least one side may be provided with a label holder.

In one embodiment the label sides of the label carrier are edged by a perimeter wall on at least one, but preferably at least three sides.

The label carrier is preferably removable attached to the second support member, but may be formed integrally with the shelf edge display fitting. In one embodiment the shelf edge display fitting is formed with an aperture in the second support member of a size and position to allow access of tooling to form the projections. The aperture may subsequently be closed by means of a plug or, in the alternative the label carrier is attached to the second support member by means of a peg formed integrally with the label carrier and adapted to fit the aperture.

Preferably the peg or plug are retained in the aperture by suitable detent means. Alternatively the peg or plug may be glued or welded in the aperture.

The second support member may be provided with means to carry a tag or swing label at its end remote from the first support member. One such tag is known in the art as an EPoS tag (Electronic Point of Sale) which is used on other display fittings to carry data (price, bar code etc.) and which is favoured by some retailers.

In one embodiment the means to carry the tag is provided by an elongate aperture substantially parallel to and adjacent the free edge of the second support member, which edge and aperture define a bar upon which the tag can freely swing by means of a clip integral with the tag.

In use the tag will hang at the end of the shelf edge display fitting enclosing all or part of the space defined by the spaced members. When it is necessary to replenish the product strip or strips the tag can be swung out of the way to allow access to the hooks.

As can be seen by one skilled in the art use of such a tag can supplement other labels on the sides of the shelf edge display fitting, but preferably would substitute said labels. This would be advantageous in terms of cost by removing the need for either adhesive labels or the provision of labels holders to each spaced member.

The shelf edge display fitting may be made from any suitable material, such as injection moulded plastics, for example.

BRIEF DESCRIPTION OF THE DRAWINGS

An embodiment of the invention will now be described, by way of example, with reference to the accompanying drawings, in which:

FIG. 3 is a section on the line III—III of FIG. 1 but showing the shelf edge display fitting bolted onto a shelf;

FIG. 4 is an end elevation of the shelf edge display fitting of FIG. 1;

DESCRIPTION OF THE PREFERRED EMBODIMENT

Figure 1:
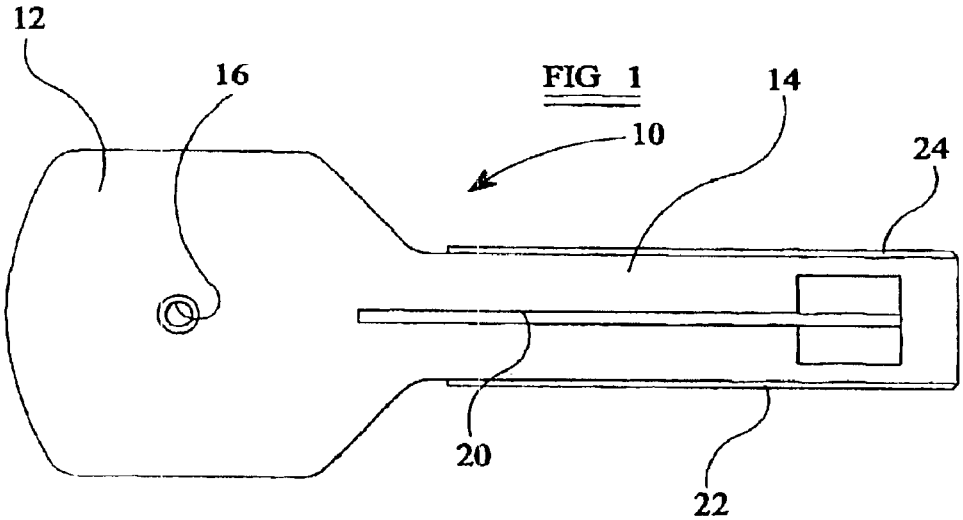
FIG. 1 is a plan of a shelf edge display fitting in accordance with the present invention.
Figure 2:
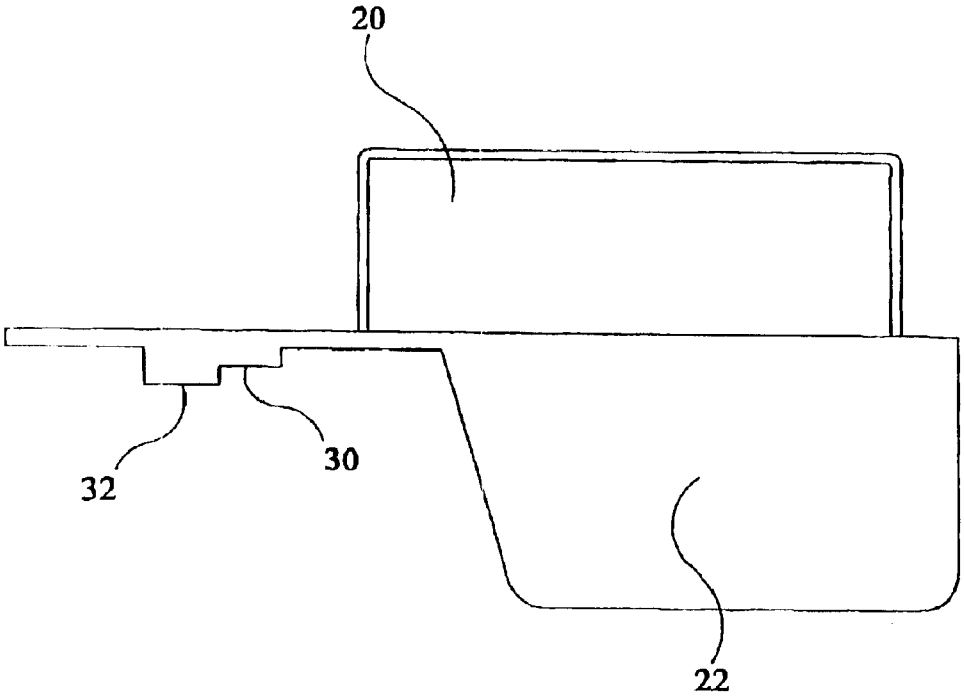
FIG. 2 is a side elevation of the shelf edge display fitting of FIG. 1.

Referring to FIGS. 1 to 4 a shelf edge display fitting 10 comprises a first support member 12 and a second support member 14 extending therefrom, the first support member 12 having a throughbore 16 to receive a bolt 18 (see FIG. 3) and the second support member 14 is provided with a label carrier 20. The second support member 14 is a relatively elongate member having a pair of spaced parallel members 22, 24 depending on from each side of the second support member 14 defining a space 26 and each carrying a hook 28 (see FIGS. 3 and 4).

The first support member has a first shoulder 30 to compensate for variations in level between shelf 34 and shelf edge 36 (see FIG. 3) and a second shoulder 32 to engage a channel 38 formed in the shelf 34.

To assist in manufacture of the shelf edge display fitting an aperture 40 is provided in the second support member 14, which aperture allows appropriate access of tooling to form hooks 28 in space 26. The aperture 40 may be simply plugged or in the embodiment shown here a label carrier 20 is attached to the second support member 14 by means of a peg 42 formed integrally with the label carrier 20 and adapted to be held in the aperture 40 by detent 44.

As can be seen clearly in FIG. 3 there is a pronounced difference in level between the shelf 34 and the shelf edge 36, which edge is provided with a label holder 45 in the form of a strip of standard construction. Shoulder 30 is of sufficient depth to maintain the shelf edge display fitting 10 level.

Both the shoulders 30 and 32 are formed as hollows 46 bounded by walls 48.

Channel 38 is provided with drainage holes 50 (only one shown) which, where a shelf edge display fitting is to be attached receive bolt 18 secured by a nut 52

Figure 5:
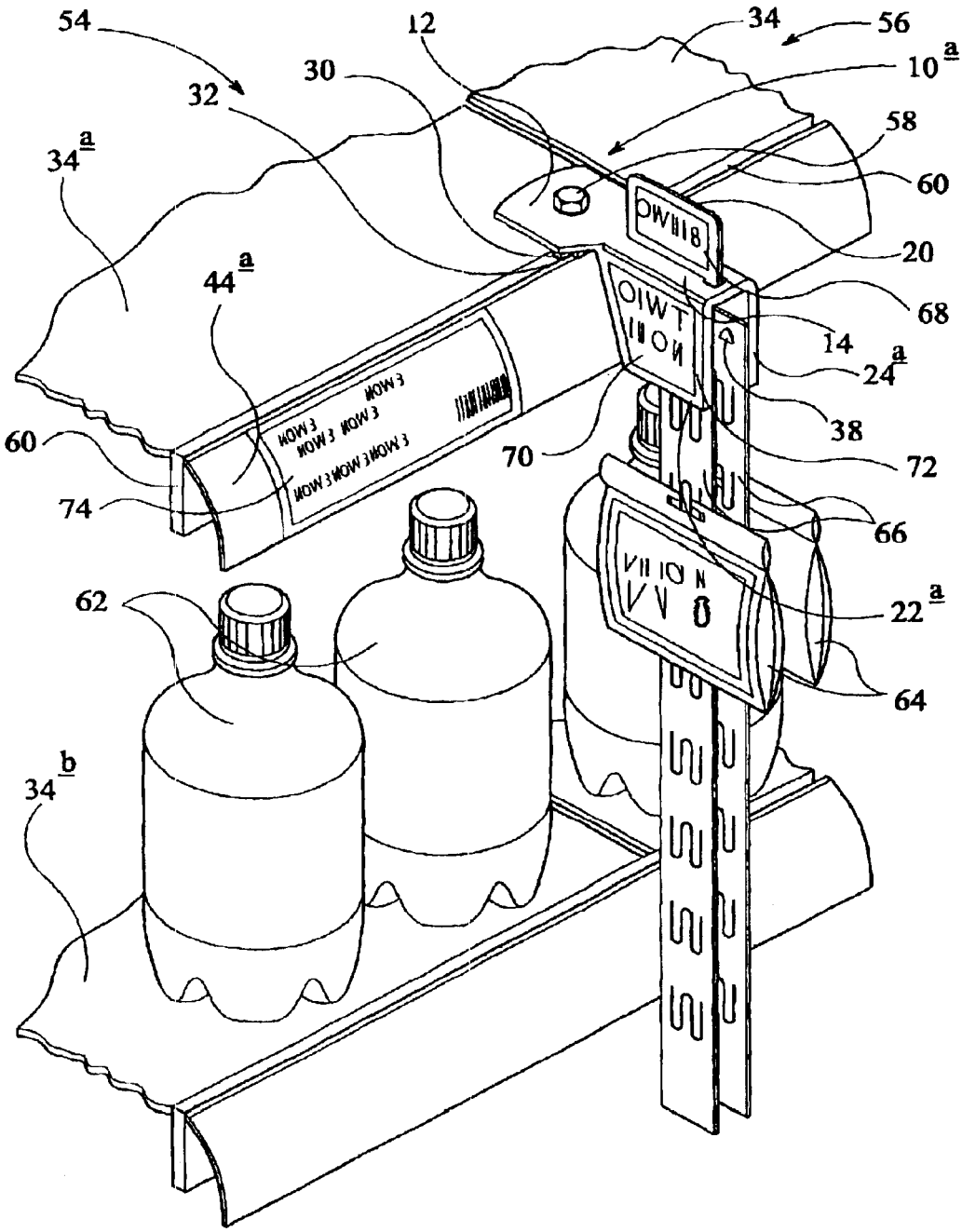
FIG. 5 is a perspective of a section of shelving showing the embodiment of shelf edge display fitting of FIGS. 1 to 4 in use.

A general arrangement showing a section of adjacent shelving 54 and 56 can be seen in FIG. 5 where a shelf edge display fitting 10*a* has been attached. Other shelves above and below this section have been omitted from the Figure as has the back section of the shelving. In this embodiment the shelf edge display fitting is positioned over a drainage hole (not shown) and is attached by a single bolt 58 through the second support member and the drainage hole in the channel 60 in the shelf 34*a*.

FIG. 5 shows a display promoting a primary product 62, in this case bottled beer, alongside a secondary product 64, in this case packets of nuts and raisins. The beer bottles 62 are arranged on the shelves 34*a* and 34*b* (only shown on shelf 34*b*) and the packets 64 are attached to strips 66 which in turn depend from hooks 38 on the second support member 14 of the shelf edge display fitting 10*a*. Appropriate shoulders 30,32 are deployed on the first support member 12 as described and illustrated in FIGS. 1 to 4.

As can be seen the shelf edge display fitting 10*a* projects away from the shelving 54 (into the aisle) thereby drawing the shopper's attention to the secondary product being promoted. Appropriate labels 68 are affixed to each side of the label carrier 20 as well as labels 70 to the exposed faces 72 of members 22*a* and 24*a*. A label 74 is shown in the label holder 44*a* of shelf 34*a*.

Figure 6:
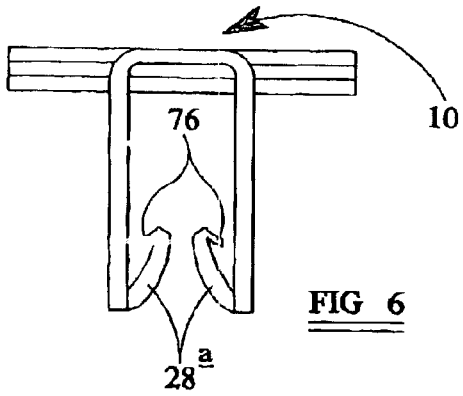
FIGS. 6 to 8 correspond to FIG. 4 but show modifications to the hooks.
Figure 7:
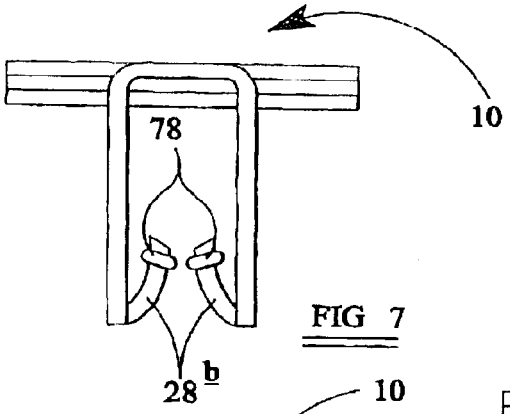
Figure 8:
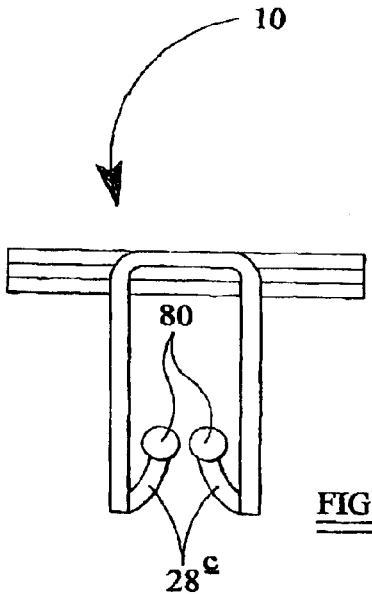

FIGS. 6, 7 and 8 each show an alternative formation of hooks 28*a*, 28*b*, 28*c* each having means to prevent accidental removal of a strip (not shown). Such means being provided by a barb(or notch) 76, a collar 78 and a knob 80 respectively.

Figure 9:
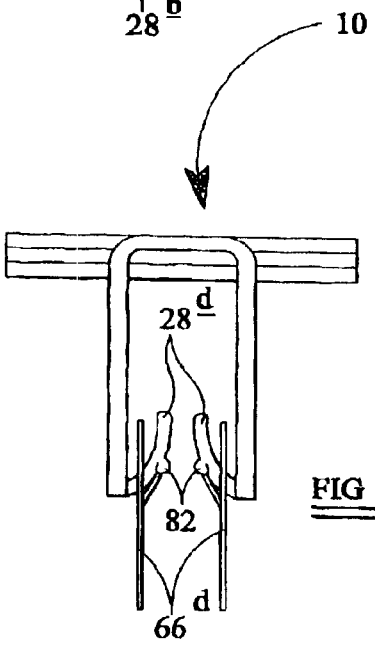
FIG. 9 corresponds to FIGS. 4, 6 to 8 but shows further alternative modified hooks.

In FIG. 9 a further alternative arrangement of hooks 28*d* is shown whereby each hook has a downwardly projecting ridge 82 adapted to resist upward movement of the strips 66*d* thereon.

Figure 11:
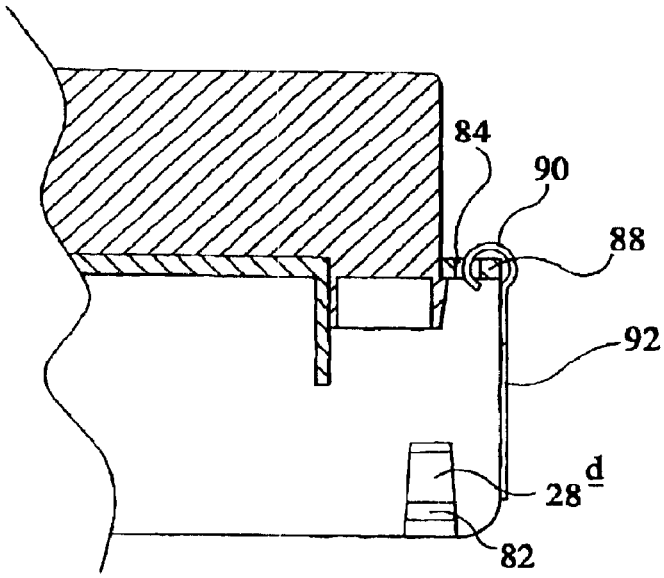
FIG. 11 corresponds to FIG. 3 but shows only a part of the second support member of the shelf edge display fitting with the tag of FIG. 10 and the modified hook of FIG. 9.

FIG. 11 also shows the ridge 82 on hook 28*d* in side elevation.

Figure 10:
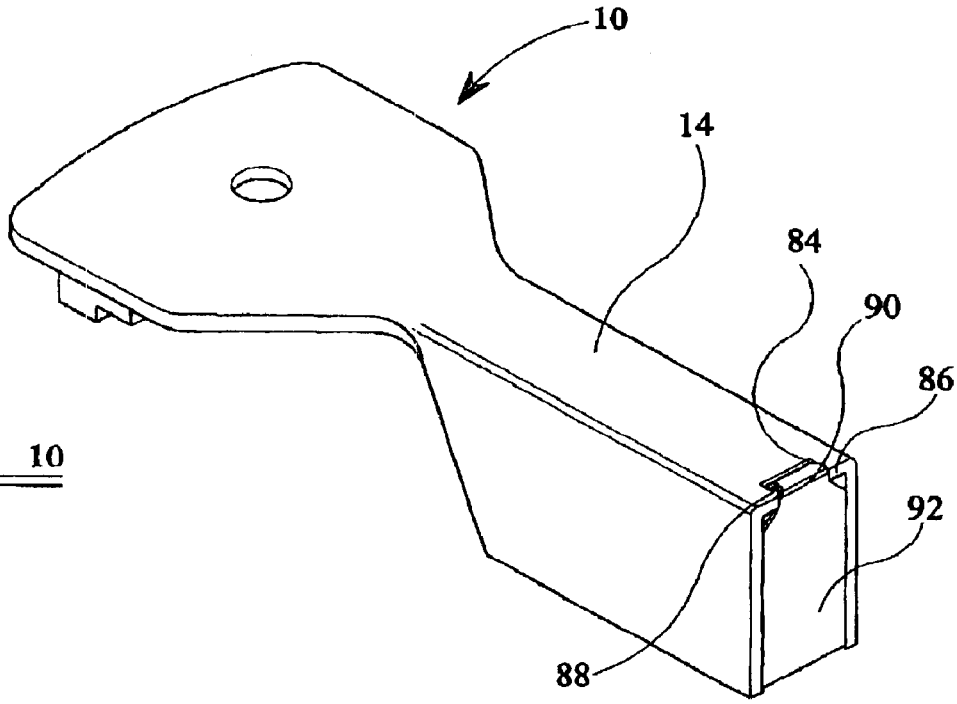
FIG. 10 is a perspective of a shelf edge display fitting similar to the embodiment described but showing the provision of a tag clipped thereto.

In FIGS. 10 and 11 two embodiments of shelf edge display fitting are shown, one without and one with a removable label carrier 20 respectively. Both embodiments are provided with an elongate aperture 84 parallel to and adjacent the free edge 86 of the second support member 14, which aperture 84 and edge 86 define a bar 88 upon which a clip 90 of a tag 92 is attached so the tag 92 can swing freely. In use the tag 92 closes the space 26 between the spaced members 22 and 24. To allow access to the space 26 and the hooks 28*d* for removal and replacement of strips the tag 92 can be readily swung upwards.

Figure 12:
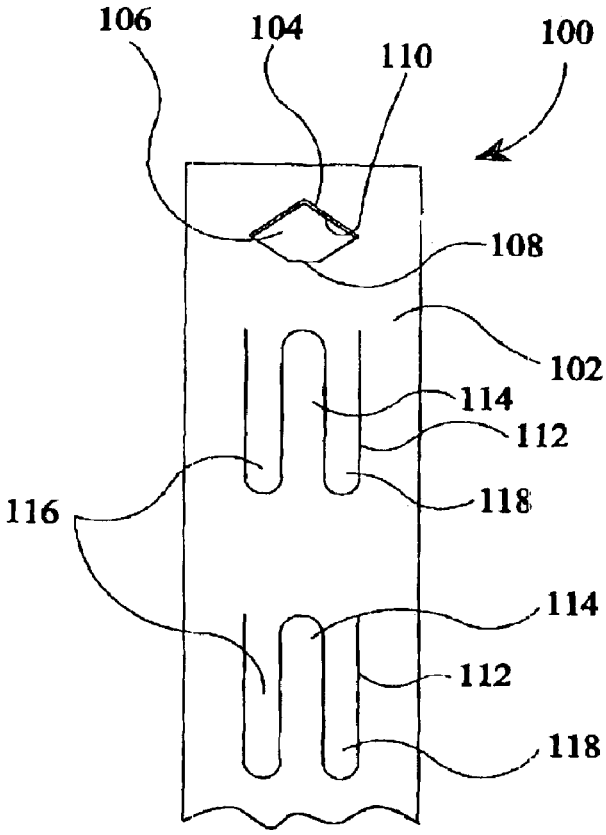
FIG. 12 is a plan of a part of a length of a display strip for use with the shelf edge display fitting.
Figure 13:
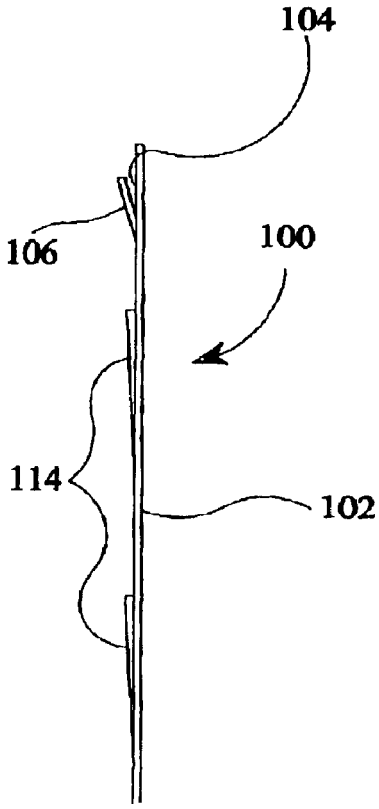
FIG. 13 is a side elevation of the display strip of FIG. 12.

In FIGS. 12 and 13 a display strip 100 for use with a shelf edge display fitting comprises an elongate strip 102 of plastics material having a first slit 104 cut therein to form a tab 106 attached to the strip by a hinged section 108, which tab is adapted to be moved about the hinged section 108 to leave an aperture 110 behind through which a projection (not shown) of an shelf edge display fitting can project to enable the strip to hang thereon.

A series of secondary slits 112 are provided in the strip each in sinusoidal form to provide a central upwardly projecting tab 114 flanked by a pair of downwardly projecting tabs 116 and 118. The upwardly projecting tab 114 is adapted to receive a slot formed in the packaging of a product to be displayed (not shown in FIGS. 12 and 13 but clearly shown in FIG. 5).

What is claimed is:

1. A shelf edge display fitting comprising a first support member adapted to be releasably attached to a shelf, a second support member extending from said first support member so that when said shelf edge display fitting is attached to a shelf said second support member extends outwardly from said shelf in a plane substantially parallel to or co-planar with the plane of said shelf, said second support member carrying at least one means to support products to be displayed, wherein said first support member is provided with at least two shoulders depending therefrom and adapted to rest upon at least part of a lowered section of said shelf edge wherein said at least two shoulders are mechanically adjustable and adapted to be moved through a series of positions to provide a variety of depths to compensate for variations in level between said shelf and said shelf edge.

2. A shelf edge display fitting as in claim 1, wherein in that each of said at least two shoulders is a solid block having a continuous lower surface for contact with said shelf edge.

3. A shelf edge display fitting as in claim 1, wherein each of said at least two shoulders is formed as a hollow bounded by walls depending from said first support member.

4. A shelf edge display fitting as in claim 1, wherein each of said at least two shoulders is formed integrally with said first support member.

5. A shelf edge display fitting as in claim 1, wherein each of said at least two shoulders is formed separately.

6. A shelf edge display fitting as in claim 5, wherein a plurality of shoulders are provided of varying depths.

7. A shelf edge display fitting as in claim 1, wherein said second support member is formed with an aperture and a label carrier is removably attached to said second support member by a peg formed integrally with said label carrier and adapted to fit said aperture, said label carrier extending upwardly and substantially perpendicular to said second support member.

8. A shelf edge display fitting as in claim 1, wherein said second support member is provided with means to carry a tag or swing label.

9. A shelf edge display fitting as in claim 8, wherein said means to carry said tag or swing label is provided by an elongate aperture substantially parallel to and adjacent a free edge of said second support member, which edge and aperture define a bar upon which a tag can swing freely.

10. A shelf edge display fitting as in claim 1, wherein there is provided at least one throughbore in said first support member to allow said shelf edge display fitting to be bolted to said shelf.

* * * * *